US010480392B2

(12) United States Patent
Yang et al.

(10) Patent No.: US 10,480,392 B2
(45) Date of Patent: Nov. 19, 2019

(54) ENGINE COOLING SYSTEM HAVING COOLANT TEMPERATURE SENSOR

(71) Applicant: HYUNDAI MOTOR COMPANY, Seoul (KR)

(72) Inventors: Kwang Sik Yang, Gunpo-si (KR); Jongmin Kim, Seoul (KR); Minseok Jang, Gumi-si (KR); Duk Jin Park, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 320 days.

(21) Appl. No.: 15/366,851

(22) Filed: Dec. 1, 2016

(65) Prior Publication Data

US 2017/0268408 A1 Sep. 21, 2017

(30) Foreign Application Priority Data

Mar. 17, 2016 (KR) ..... 10-2016-0032321

(51) Int. Cl.
*F01P 7/14* (2006.01)
*F01P 7/16* (2006.01)
*F01P 3/00* (2006.01)

(52) U.S. Cl.
CPC ..... *F01P 7/165* (2013.01); *F01P 3/00* (2013.01); *F01P 7/167* (2013.01);
(Continued)

(58) Field of Classification Search
CPC .... F01P 7/165; F01P 3/00; F01P 7/167; F01P 2007/146; F01P 2025/30; F01P 2025/32
(Continued)

(56) References Cited

U.S. PATENT DOCUMENTS 6,223,700 B1 * 5/2001 Sano ..... F01P 7/167 123/41.02
6,857,398 B2 * 2/2005 Takagi ..... F01P 7/167 123/41.1

(Continued)

FOREIGN PATENT DOCUMENTS

JP 05231148 A 9/1993
JP 2007120312 A 5/2007

(Continued)

*Primary Examiner* — Hung Q Nguyen
*Assistant Examiner* — Anthony Donald Taylor, Jr.
(74) *Attorney, Agent, or Firm* — Brinks Gilson & Lione

(57) ABSTRACT

The present disclosure provides an engine cooling system having a coolant temperature sensor, including a radiator disposed to release heat of coolant circulated in an engine; a coolant control valve unit controlling the coolant circulated in the radiator through opening rate of a valve having a coolant passage corresponding to the radiator; a second coolant temperature sensor sensing a coolant temperature at a coolant outlet side of the engine; a third coolant temperature sensor sensing the coolant temperature at the coolant outlet side of the radiator; and a control unit sensing second and third coolant temperatures through the second and third coolant temperature sensors, calculating a first coolant temperature at a coolant inlet side of the engine by calculating the second and third coolant temperatures, and calculating valve opening rate of the coolant control vale by using the first, second, and the third coolant temperature.

7 Claims, 14 Drawing Sheets

(52) U.S. Cl.
CPC ..... *F01P 2007/146* (2013.01); *F01P 2025/30* (2013.01); *F01P 2025/32* (2013.01)

(58) Field of Classification Search
USPC ..... 123/41.08
See application file for complete search history.

(56) References Cited

U.S. PATENT DOCUMENTS

| | | | | |
|---|---|---|---|---|
| 2004/0065275 | A1* | 4/2004 | Hayami | F01P 7/164 123/41.1 |
| 2006/0157000 | A1* | 7/2006 | Lutze | F01P 3/20 123/41.02 |
| 2006/0288967 | A1* | 12/2006 | Joyce | F01P 7/167 123/41.08 |
| 2009/0139686 | A1* | 6/2009 | Suzuki | B60K 6/445 165/42 |
| 2009/0140055 | A1* | 6/2009 | Iwasaki | F16K 31/002 236/34.5 |
| 2012/0137993 | A1* | 6/2012 | Kim | F01P 7/165 123/41.11 |
| 2016/0010536 | A1* | 1/2016 | Murakami | F16K 11/085 137/625.44 |

FOREIGN PATENT DOCUMENTS

| | | | |
|---|---|---|---|
| JP | 2008051073 | A | 3/2008 |
| JP | 2008-144674 | A | 6/2008 |
| KR | 10-0361305 | B2 | 11/2002 |
| KR | 10-0521913 | B2 | 10/2005 |

* cited by examiner

FIG. 4

$$\text{(OPENING RATE)}\quad \alpha = \frac{B0(T2-T1)}{A1(T1-T3) - (B1-B0)(T2-T1)}$$

ENGINE COOLING SYSTEM HAVING COOLANT TEMPERATURE SENSOR

CROSS-REFERENCE TO RELATED APPLICATION

This application claims priority to and the benefit of Korean Patent Application No. 10-2016-0032321, filed on Mar. 17, 2016, the entire contents of which are incorporated herein by reference.

FIELD

The present disclosure relates to an engine cooling system having a coolant temperature sensor.

BACKGROUND

The statements in this section merely provide background information related to the present disclosure and may not constitute prior art.

An engine generates rotary force by the combustion of fuel and the remainder is discharged as thermal energy. In particular, coolant absorbs the thermal energy while being circulated through the engine, a heater, and the radiator and releases the absorbed thermal energy to the outside.

When a temperature of the coolant of the engine is low, viscosity of oil increases and friction force tends to thus increase, fuel consumption tends to increase, the temperature of exhaust gas slowly increases, an activation time of a catalyst is lengthened, and the quality of the exhaust gas may deteriorate. Moreover, a time when a function of a heater is normalized may be lengthened.

When the coolant temperature of the engine is excessive, knocking occurs and in order to suppress the knocking, an ignition time is controlled, and as a result, performance may deteriorate. Further, when the temperature of a lubricant is excessive, lubrication may deteriorate.

Therefore, one coolant control valve unit is applied, which controls multiple cooling elements through one valve, such as keeping the coolant at a high temperature at a specific portion while keeping the coolant at a low temperature in other portions.

The coolant control valve unit controls the coolant which is circulated through each of the engine (an oil cooler, the heater, an EGR cooler, and the like) and the radiator to improve overall cooling efficiency of the engine and reduce the fuel consumption.

Therefore, the coolant temperature at a predetermined location is sensed by using the coolant temperature sensor, a target coolant temperature is set according to a driving condition, and the coolant control valve unit is controlled according to the target coolant temperature.

In particular, a method may be used, which arranges the coolant temperature sensors sensing the coolant temperatures at a coolant inlet side and a coolant outlet side of the engine and an outlet side of the radiator and controlling valve opening rate of the coolant control valve unit according to the coolant temperature sensed by the coolant sensors.

Meanwhile, research has progressed, which minimizes the number of the coolant temperature sensors, senses the coolant temperature at a predetermined location by using the already arranged coolant temperature sensor, calculates the coolant temperature at the predetermined location, and rapidly changes valve opening rate of the coolant control valve unit when the target coolant temperature is changed by using the sensed coolant temperature and the calculated coolant temperature.

The above information disclosed in this Background section is only for enhancement of understanding of the background of the disclosure and therefore it may contain information that does not form the prior art that is already known to a person of ordinary skill in the art.

Further areas of applicability will become apparent from the description provided herein. It should be understood that the description and specific examples are intended for purposes of illustration only and are not intended to limit the scope of the present disclosure.

SUMMARY

The present disclosure provides an engine cooling system having a coolant temperature sensor which senses coolant temperatures at a coolant inlet side of an engine and a coolant outlet side of a radiator by using a coolant temperature sensor or selects the coolant temperature according to a driving condition, calculates the coolant temperature at the coolant inlet side of the engine, and rapidly changes valve opening rate of a coolant control valve unit when a target coolant temperature is changed to a set value or more by using the sensed coolant temperatures and the calculated coolant temperature.

One form of the present disclosure provides an engine cooling system having a coolant temperature sensor, including: an internal combustion engine; a radiator disposed at a first side of the engine and disposed to dissipate heat of coolant circulated in and discharged from the engine to the outside; a coolant control valve unit controlling coolant circulated in the radiator through an opening rate of a valve having a coolant passage at a radiator side; a second coolant temperature sensor sensing a second coolant temperature at a coolant outlet side of the engine; a third coolant temperature sensor sensing a third coolant temperature of coolant discharged from the radiator at a coolant outlet side of the radiator; and a control unit sensing the second and third coolant temperatures through the second and third coolant temperature sensors, respectively, calculating a first coolant temperature at a coolant inlet side of the engine by the second and third coolant temperatures sensed, and calculating a valve opening rate of the coolant control vale by using the first, the second, and the third coolant temperatures.

The second coolant temperature sensor may be disposed at the coolant outlet side of the engine, the coolant control valve unit is disposed at a rear stage thereof, and the radiator is installed on a branch line branched from a coolant line downstream of the second coolant temperature sensor, and the heated coolant discharged from the engine and the cooled coolant discharged from the radiator may be aggregated in the coolant control valve unit and thereafter, circulated to the coolant inlet side of the engine.

The control unit may calculate or select or determine the first coolant temperature from predetermined map data based on at least one of the second and third coolant temperatures, Revolutions per Minute (RPM) of the engine, and output torque of the engine.

The valve opening rate of the coolant control valve unit may be calculated through an equation given below:

$$\text{Equation: valve opening rate } a=(B0*(T2-T1))/(A1*(T1-T3)-(B1-B0)*(T2-T1)),$$

where B0 represents the flow of the coolant of the engine while the opening rate of the coolant passage at the radiator side is 0, T2 represents the second coolant temperature, T1 represents the first coolant temperature, A1 represents the flow of the coolant of the radiator while the coolant passage at the radiator side is fully opened by the valve, T3 represents the third coolant temperature, and B1 represents the flow of the coolant of the engine while the coolant passage at the radiator side is fully opened by the valve.

The control unit may calculate a heat transfer of the engine and the flow of the coolant passing through the engine based on at least one of the second and the third coolant temperatures, the RPM of the engine, and an output torque of the engine, and calculate the first coolant temperature at the coolant inlet side of the engine based on the calculated heat transfer amount and flow of the coolant passing through the engine.

The control unit may calculate the first coolant temperature by using an equation given below:

Equation: $Q=M*Cp*(T2-T1)$, where, Q represents the engine heat transfer amount, M represents the flow of the coolant passing through the engine, Cp represents a specific heat of the coolant, T2 represents the second coolant temperature (a sensed value or a target value), and T1 represents the first coolant temperature (a calculated value).

The control unit may calculate a new target coolant temperature according to a driving condition, determine if a difference between the calculated new target coolant temperature and the existing target coolant temperature is more than a set value, and calculate the valve opening rate of the coolant control valve by using the first, the second, and third coolant temperatures, and control the current valve opening rate to reach the calculated valve opening rate by jumping-controlling the coolant control valve unit.

The control unit may control the current valve opening rate to reach the calculated valve opening rate by jumping-controlling the coolant control valve unit and control the valve by at least one of proportional-integral (PI) control, proportional-integral-derivative (PID) control, and predetermined map data control according to the driving condition.

The flow of the coolant passing through the engine may be selected from the map data corresponding to the RPM of the engine.

According to forms of the present disclosure, a coolant temperature at an outlet side of an engine is sensed or set to a target temperature value by using two coolant temperature sensors and the coolant temperature at an inlet side of the engine is easily calculated by sensing the coolant temperature at an outlet side of the radiator, thereby reducing component cost.

Moreover, a valve opening rate of a coolant control valve unit is calculated by using the calculated coolant temperature at the engine inlet and jumping control is performed at the calculated opening rate to improve rapidity and reactivity of the control.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 4 illustrates an equation for calculating valve opening rate in the engine cooling system according to one form of the present disclosure;

Figure 1:
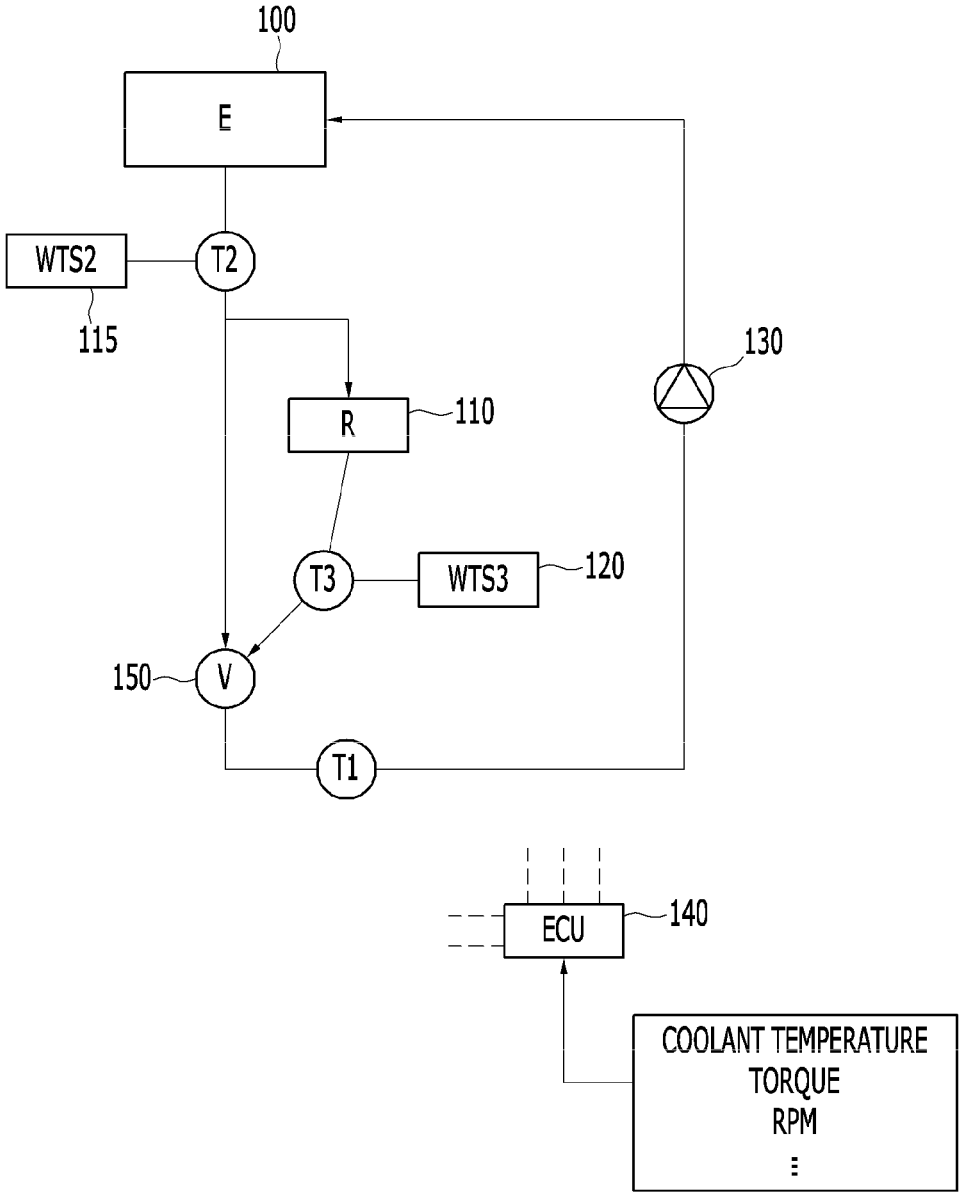
FIG. 1 is a schematic configuration diagram of an engine cooling system having a coolant temperature sensor according to one form of the present disclosure.

The drawings described herein are for illustration purposes only and are not intended to limit the scope of the present disclosure in any way.

DESCRIPTION OF SYMBOLS

100: Engine 110: Radiator
115: Second coolant temperature sensor
120: Third coolant temperature sensor
150: Coolant control valve unit 130: Coolant pump
140: Control unit 200: Rotary valve
T1: First coolant temperature T2: Second coolant temperature
T3: Third coolant temperature

DETAILED DESCRIPTION

The following description is merely exemplary in nature and is not intended to limit the present disclosure, application, or uses. It should be understood that throughout the drawings, corresponding reference numerals indicate like or corresponding parts and features.

The size and thickness of each component illustrated in the drawings are arbitrarily represented for convenience in explanation, and the present disclosure is not particularly limited to the illustrated size and thickness of each component and the thickness is enlarged and illustrated in order to clearly express various parts and areas.

However, parts not associated with description are omitted to clearly describe the forms of the present disclosure and like reference numerals designate like elements throughout the specification.

In the following description, names of components, which are in the same relationship, are divided into "the first", "the second", and the like to distinguish the components, but the present disclosure is not limited to the order.

FIG. 1 is a schematic configuration diagram of an engine cooling system having a coolant temperature sensor according to one form of the present disclosure.

Referring to FIG. 1, the engine cooling system includes an engine 100, a coolant control valve unit 150, a coolant pump 130, a radiator 110, a control unit 140, a second coolant temperature sensor 115, and a third coolant temperature sensor 120.

The coolant control valve unit 150 is disposed to control coolant passing through the radiator 110 and coolant discharged from the engine 100 and the coolant pump 130 pumps the coolant to circulate the coolant.

The second coolant temperature sensor 115 is disposed to sense the temperature of the coolant discharged from the engine 100 and the third coolant temperature sensor 120 is disposed to sense the temperature of the coolant discharged from the radiator 110.

The control unit 140 senses the coolant temperatures from the second coolant temperature sensor 115 and the third coolant temperature sensor 120 and controls the coolant control valve unit 150 and the coolant pump 130 according to a driving condition.

Moreover, the control unit 140 may calculate the temperature of the coolant which flows into the engine 100 according to the coolant temperatures sensed from the second coolant temperature sensor 115 and the third coolant temperature sensor 120 and the driving condition.

The control unit 140 may be implemented as one or more microprocessors that operate by a set program and the set program may include a series of commands for performing a method according to one form of the present disclosure.

Figure 2:
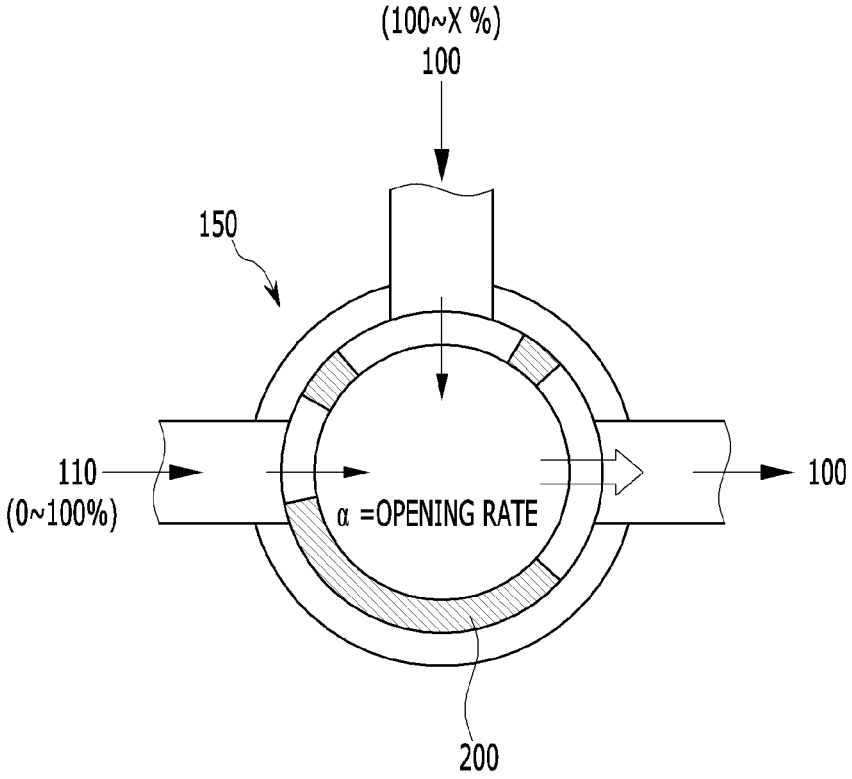
FIG. 2 is a schematic cross-sectional view illustrating an operating principle of a coolant control valve unit in the engine cooling system according to one form of the present disclosure.

FIG. 2 is a schematic cross-sectional view illustrating an operating principle of a coolant control valve unit in the engine cooling system according to one form of the present disclosure.

Referring to FIG. 2, the coolant control valve unit 150 includes a rotary valve 200 having a coolant passage and an opening rate of the coolant passage varies depending on a rotational amount of the rotary valve 200.

In one form of the present disclosure, the opening rate a may be the opening rate of the coolant passage of the rotary valve 200 connected with the radiator 110. Therefore, the amount of coolant cooled through the radiator 110 is controlled according to a rotation angle of the rotary valve 200.

Moreover, the coolant cooled by the radiator 110 and the coolant heated by the engine 100 are aggregated and thereafter, circulated to the inlet side of the engine 100 again.

Figure 3:
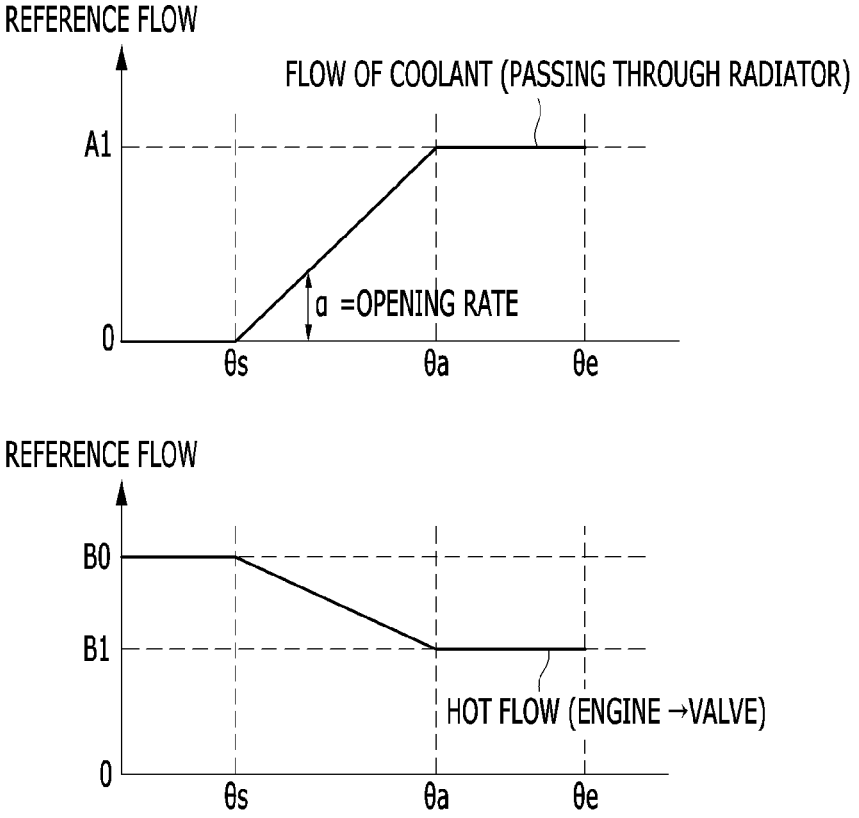
FIG. 3 is a graph showing a flow depending on a valve rotation angle of the coolant control valve unit in the engine cooling system according to one form of the present disclosure.

FIG. 3 is a graph showing a flow depending on a valve rotation angle of the coolant control valve unit 150 in the engine cooling system according to one form of the present disclosure.

Referring to FIG. 3, a horizontal axis represents the rotation angle of the rotary valve 200 of the coolant control valve unit 150 and a vertical axis represents a reference flow. The reference flow is set according to an RPM of the engine 100.

The opening rate of each coolant passage varies according to the rotation angle of the rotary valve 200, and as a result, the amount of the coolant cooled through the radiator 110 varies from 0 to A1 and proportionally increases, and the amount of the heated coolant discharged from the engine 100 varies from B0 to B1 and proportionally decreases.

FIG. 4 illustrates an equation for calculating a valve opening rate in the engine cooling system according to one form of the present disclosure and referring to FIG. 4, the valve opening a may be expressed as the valve opening rate $a=(B0*(T2-T1))/(A1*(T1-T3)-(B1-B0)*(T2-T1))$.

Where, B0 represents the flow of the coolant of the engine while the opening rate of the coolant passage at the radiator 110 side is 0, T2 represents a second coolant temperature, T1 represents a first coolant temperature, A1 represents the flow of the coolant of the radiator 110 while the coolant passage at the radiator 110 side is fully opened by the valve, T3 represents a third coolant temperature, and B1 represents the flow of the coolant of the engine 100 while the coolant passage at the radiator 110 side is fully opened by the valve 200.

The opening rate of the valve 200 may be calculated by the equation, and in one form of the present disclosure, the second coolant temperature T2 and the third coolant temperature T3 are sensed by the second coolant temperature sensor 115 and the third coolant temperature sensor 120, respectively, and the first coolant temperature T1 is calculated by the control unit 140. A method for calculating the first coolant temperature T1 will be described with the drawing.

Figure 5:
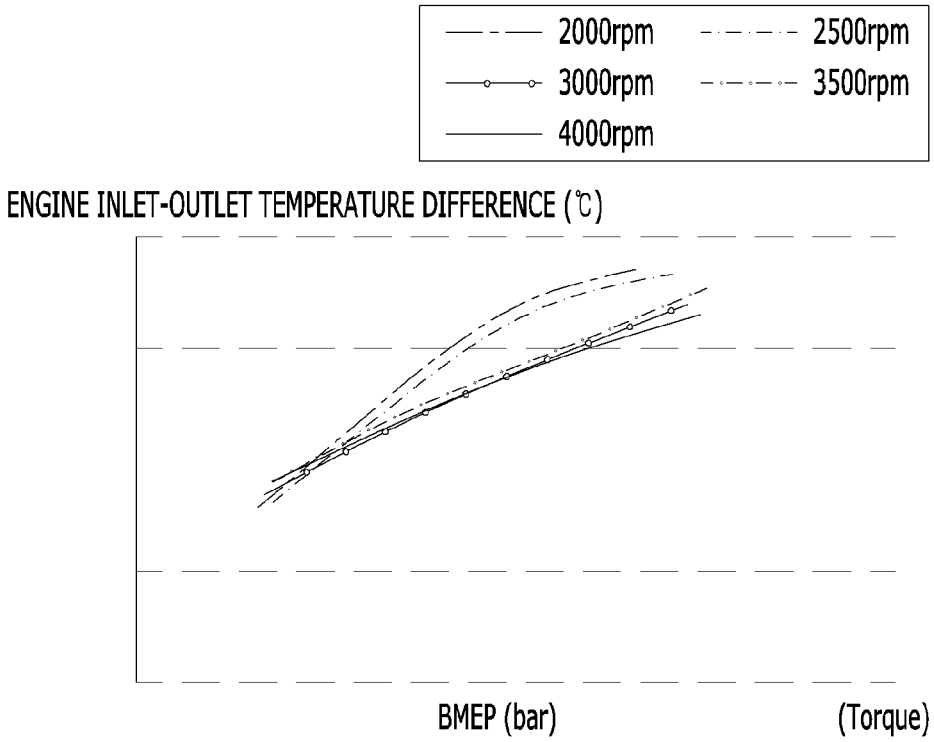
FIG. 5 is a graph showing an engine RPM and a temperature difference between a coolant inlet and a coolant outlet of an engine depending on engine torque in the engine cooling system according to one form of the present disclosure.

FIG. 5 is a graph showing an engine RPM and a temperature difference between a coolant inlet and a coolant outlet of an engine depending on engine torque in the engine cooling system according to one form of the present disclosure.

Referring to FIG. 5, the horizontal axis represents engine torque as a brake mean effective pressure (BMEP) and the vertical axis represents a temperature difference T1−T2 between the inlet and the outlet of the engine 100.

Moreover, the temperature difference between the coolant inlet and the coolant outlet of the engine 100 slightly varies according to the RPM of the engine 100. This is stored as experimental data in a memory in a map data format and the control unit 140 uses the stored data.

Figure 6:
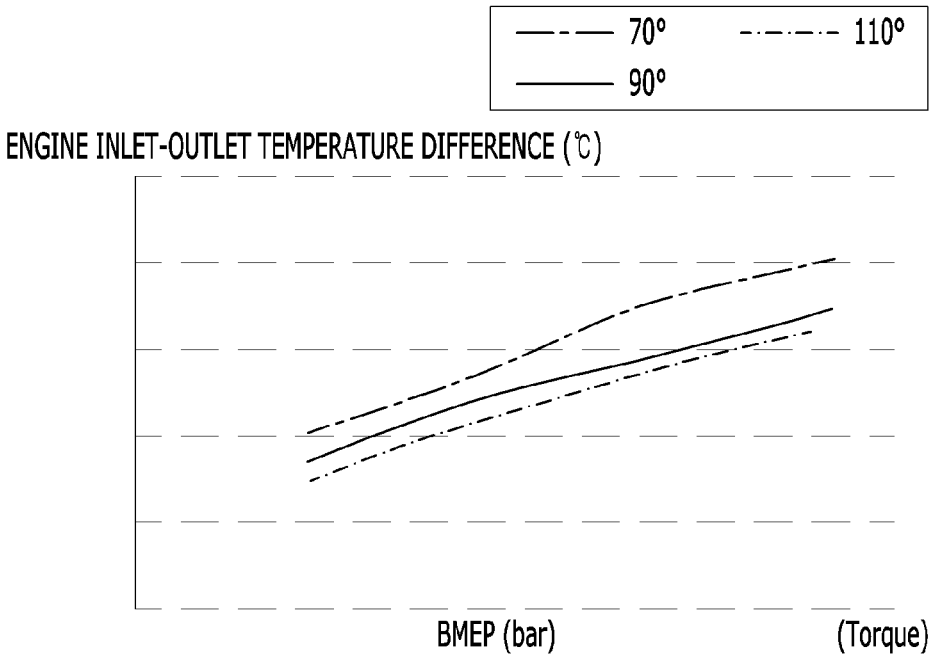
FIG. 6 is a graph showing a coolant temperature and the temperature difference between the coolant inlet and the coolant outlet of the engine depending on the engine torque in the engine cooling system according to one form of the present disclosure.

FIG. 6 is a graph showing a coolant temperature and the temperature difference between the coolant inlet and the coolant outlet of the engine depending on the engine torque in the engine cooling system according to one form of the present disclosure.

Referring to FIG. 6, the horizontal axis represents the engine torque as the brake mean effective pressure (BMEP) and the vertical axis represents the temperature difference T1−T2 between the inlet and the outlet of the engine 100.

Moreover, the temperature difference between the coolant inlet and the coolant outlet of the engine 100 slightly varies according to the coolant. Herein, the coolant temperature may be the second coolant temperature T2 sensed by the second coolant sensor 115 and stored in the memory in the map data format as the experimental data and the control unit 140 uses the stored data.

Figure 7:
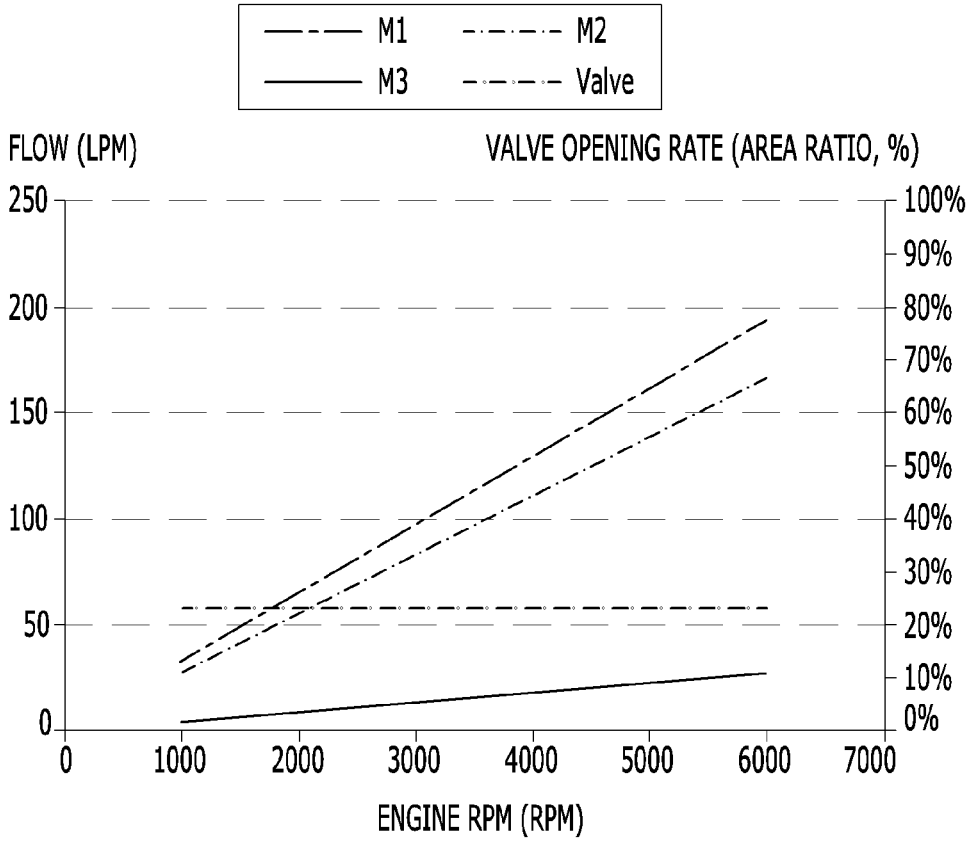
FIG. 7 is a graph showing a flow and valve opening rate depending on the engine RPM in the engine cooling system according to one form of the present disclosure.

FIG. 7 is a graph showing a flow and valve opening rate depending on the engine RPM in the engine cooling system according to one form of the present disclosure.

Referring to FIG. 7, the horizontal axis represents the engine RPM and the vertical axis represents the flow of the coolant and the opening rate of the valve.

M1 represents a total flow of the coolant, M2 represents the flow of the heated coolant which moves from the engine 100 to the valve 200, and M3 represents the flow of the cooled coolant through the radiator 110. "Valve" represents the opening rate of the valve 200 and the valve opening rate may be constantly maintained at 20 to 30% in order to maintain the temperature.

Figure 8:
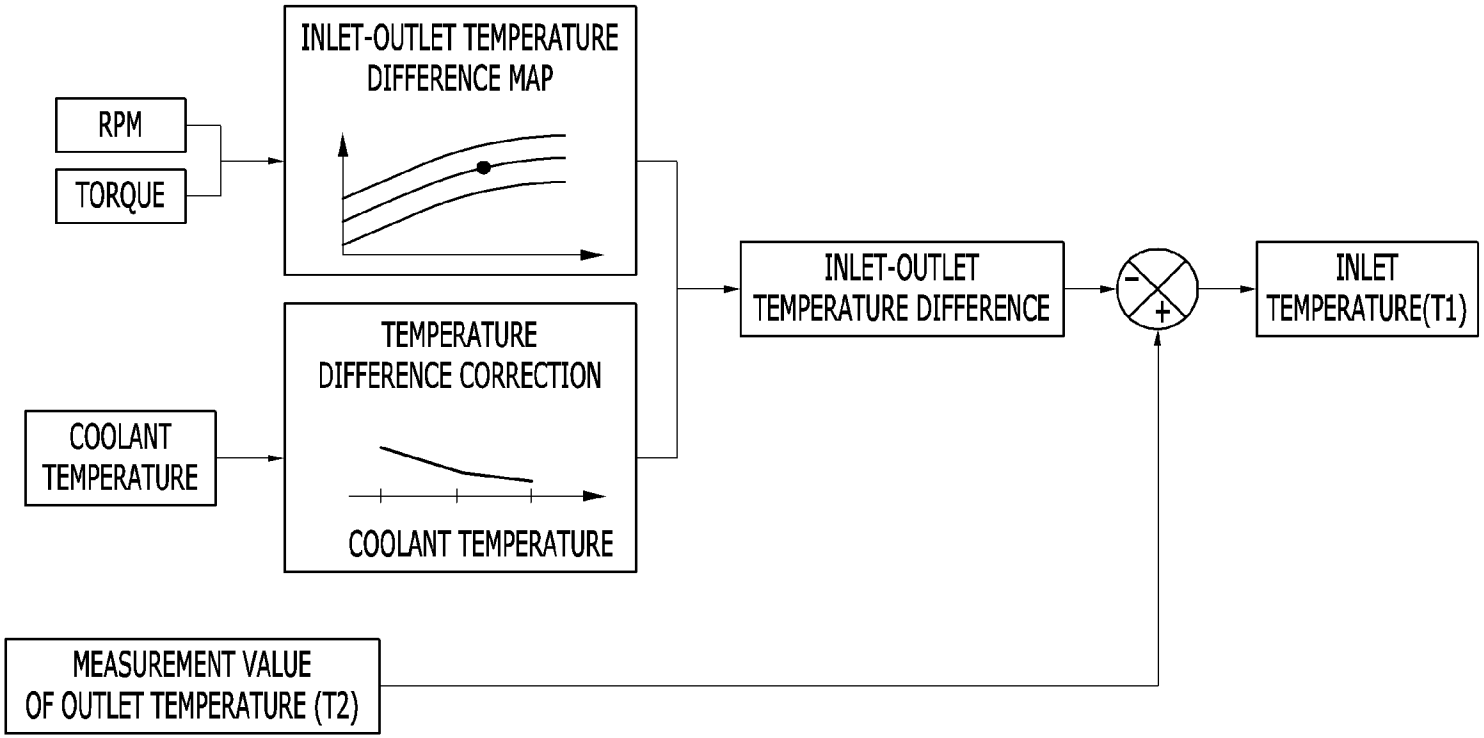
FIGS. 8 and 9 are graphs showing a method for calculating a coolant temperature at a coolant inlet side of the engine depending on a driving condition in the engine cooling system according to one form of the present disclosure.
Figure 9:
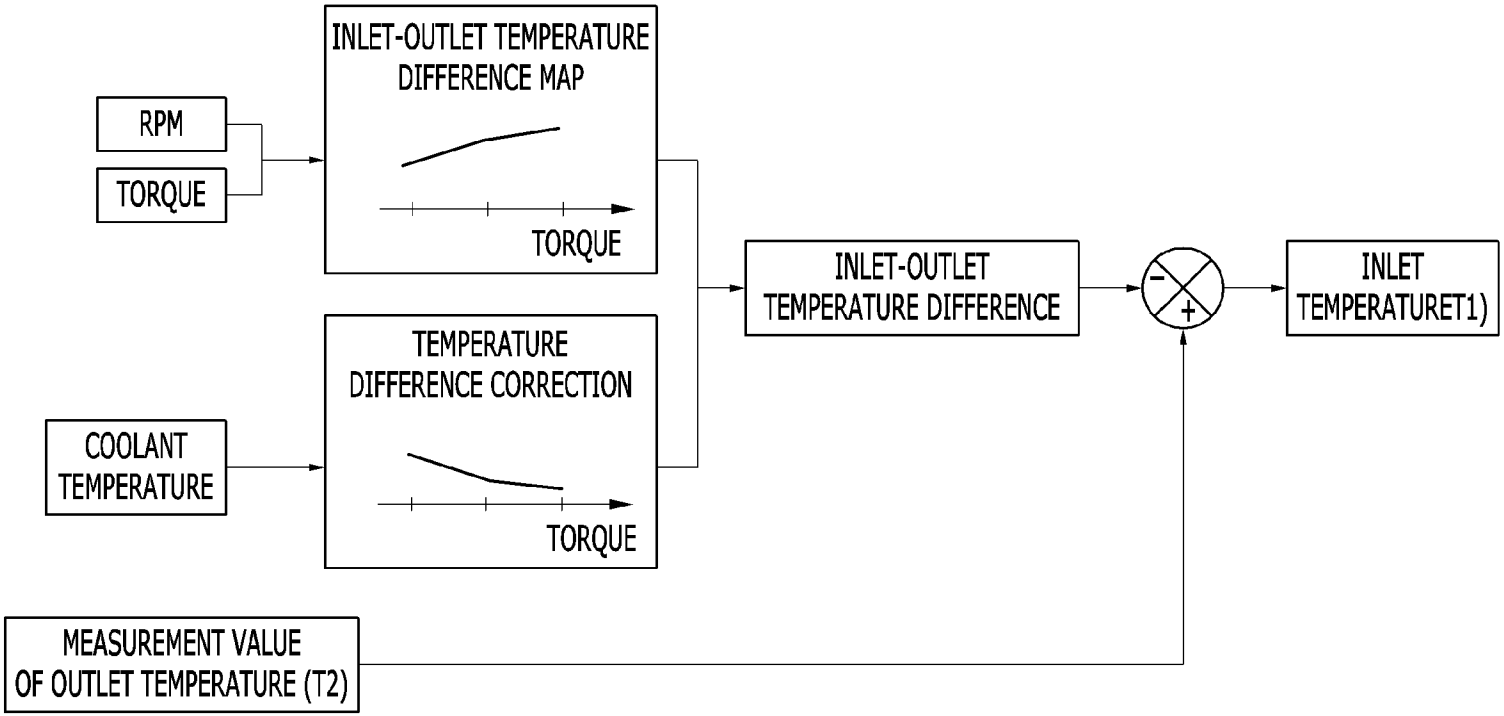

FIGS. 8 and 9 are graphs showing a method for calculating a coolant temperature at a coolant inlet side of the engine depending on a driving condition in the engine cooling system according to the exemplary form of the present disclosure.

Referring to FIG. 8, the temperature difference T2−T1 between the coolant inlet and the coolant outlet of the engine 100 is selected according the RPM and the output torque of the engine 100, and the inlet-outlet temperature difference is corrected by the sensed second coolant temperature T2 to calculate a final inlet-outlet temperature difference T2−T1.

In one form of the present disclosure, the map data of FIG. 5 is used in FIG. 8.

Referring to FIG. 9, the temperature difference T2−T1 between the coolant inlet and the coolant outlet of the engine 100 is selected according the output torque of the engine 100 and the inlet-outlet temperature difference is corrected by the sensed second coolant temperature T2 to calculate the final inlet-outlet temperature difference T2−T1.

In one form of the present disclosure, the map data of FIG. 6 is used in FIG. 9.

Figure 10:
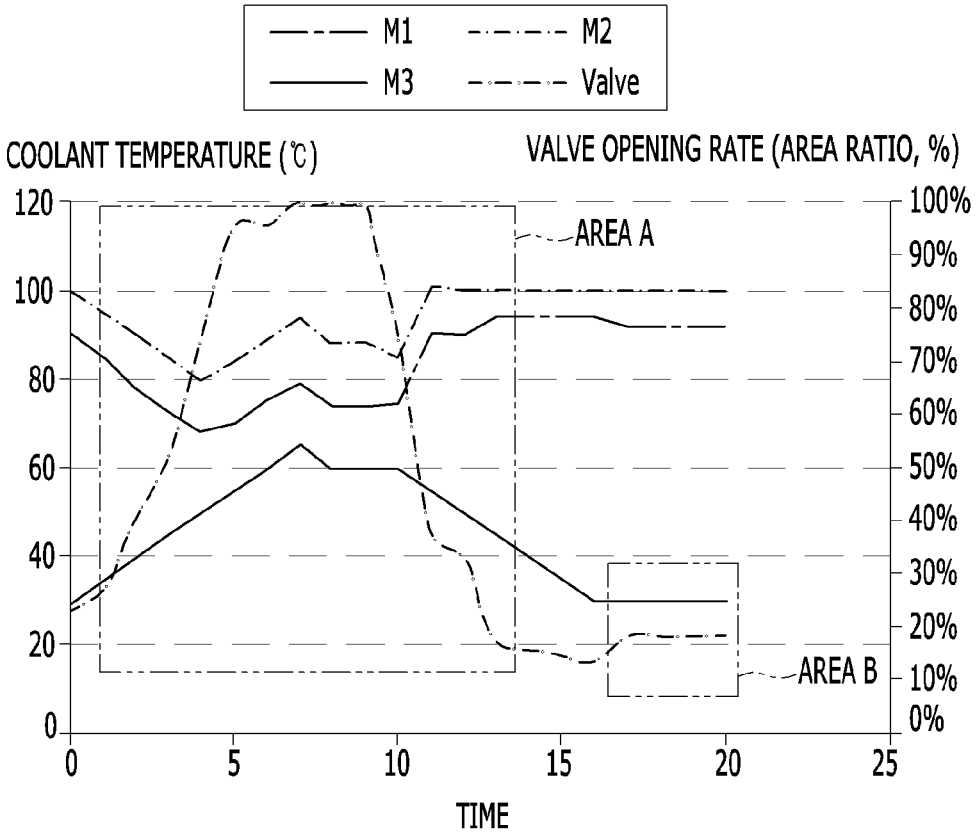
FIG. 10 is a graph showing the coolant temperature and the valve opening rate at each point in the engine cooling system according to one form of the present disclosure.

FIG. 10 is a graph showing the coolant temperature and the valve opening rate at each point in the engine cooling system according to one form of the present disclosure.

Referring to FIG. 10, the horizontal axis represents a time, the vertical axis represents the coolant temperature and the valve opening rate, T1, T2, and T3 represent the coolant temperatures at respective points, and "valve" represents the valve opening rate of the coolant passage connected with the radiator 110.

In one form of the present disclosure, a target coolant temperature is set to T2 and the target coolant temperature is divided into an area A in which the second coolant temperature T2 is rapidly changed and an area B in which the second coolant temperature T2 is not changed.

In the area A, according to the target coolant temperature, T1, T2, and T3 vary and the opening rate of the coolant passage connected with the radiator 110 increases or decreases. In addition, in the area B, the temperature and the opening rate of the valve 200 are constantly maintained or minutely controlled.

Figure 11:
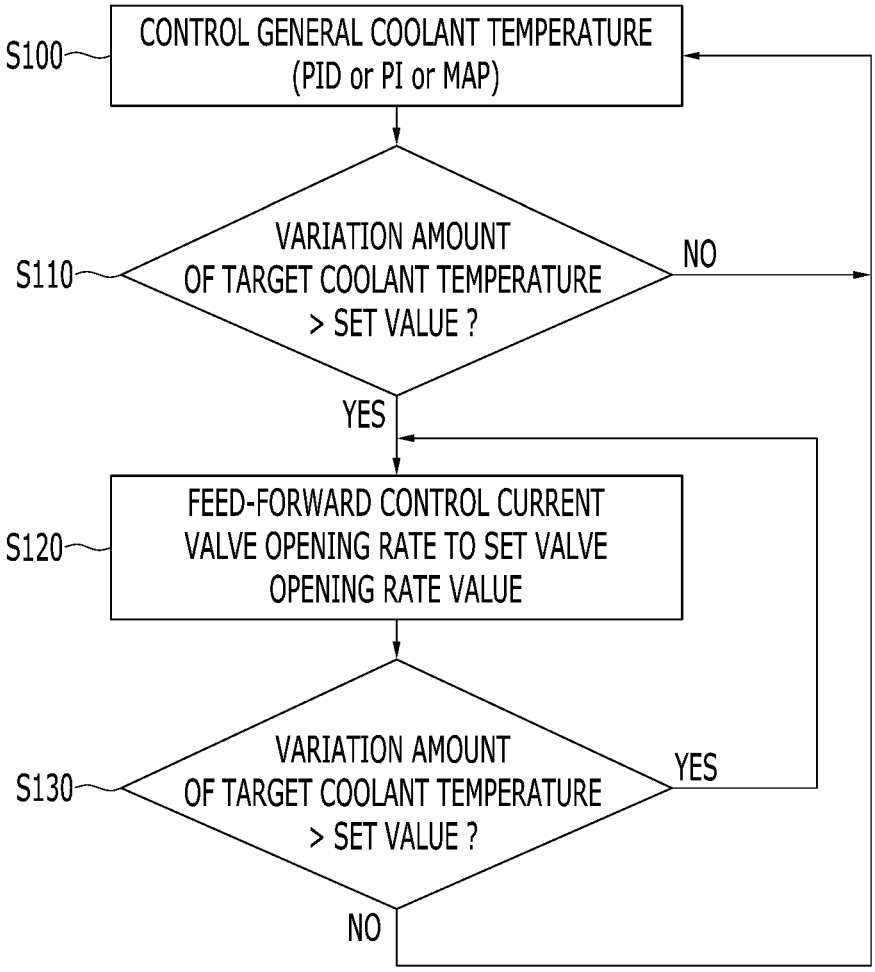
FIG. 11 is a flowchart illustrating a method for controlling a coolant temperature in an engine cooling system according to one form of the present disclosure.

FIG. 11 is a flowchart illustrating a method for controlling a coolant temperature in an engine cooling system according to one form of the present disclosure.

Referring to FIG. 11, general coolant temperature control is performed in S100. The control includes a proportional-integral-derivative (PID), proportional-integral (PI), or Map control.

In S110, it is determined whether a variation amount of a target coolant temperature is larger than a set value. When the variation amount of a target coolant temperature is equal to or smaller than a set value, S110 is performed and when the variation amount is larger than the set value, S120 is performed.

In S120, the opening rate of the valve 200 is jumping-controlled to a set value. Herein, the jumping control represents rapidly switching the opening rate of the valve from current first opening rate to second opening rate and is different from the PI, PID, or Map control that slowly switches the opening rate.

In addition, in S130, when the variation amount of the target coolant temperature is larger than a predetermined value and when the variation amount is equal to or smaller than the predetermined value, S100 is performed and when the variation amount is larger than the predetermined value, S120 is performed again.

Figure 12:
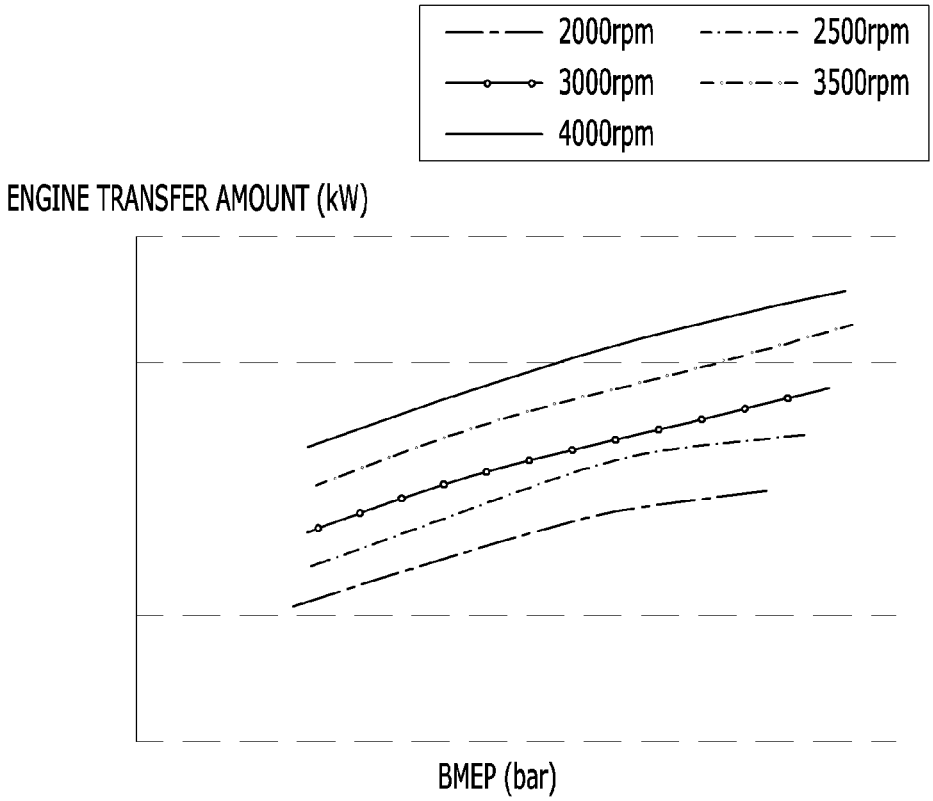
FIG. 12 is a graph showing an engine RPM and an engine heat transfer amount depending on engine torque in the engine cooling system according to one form of the present disclosure.

FIG. 12 is a graph showing an engine RPM and an engine heat transfer amount depending on engine torque in the engine cooling system according to one form of the present disclosure.

Referring to FIG. 12, the horizontal axis as the BMEP represents the output torque of the engine 100 and the vertical axis represents a heat transfer amount of the engine 100 depending on the engine RPM.

The heat transfer amount of the engine 100 increases in proportion to the engine torque and the engine RPM and the experimental data is stored in the memory as a map data type and the control unit 140 selectively uses the data.

Since the engine heat transfer Q is M*Cp*(T2−T1), when the engine heat transfer amount, the flow of the coolant, and T2 (a sensed value or a target value) are known, T1 (first coolant temperature) may be inversely calculated. Herein, Cp is handled as a constant.

Therefore, the opening rate of the valve 200 is calculated by T1, T2 (target value), and T3 (sensed value), and as a result, the opening rate of the valve 200 may be rapidly jumping-controlled.

Figure 13:
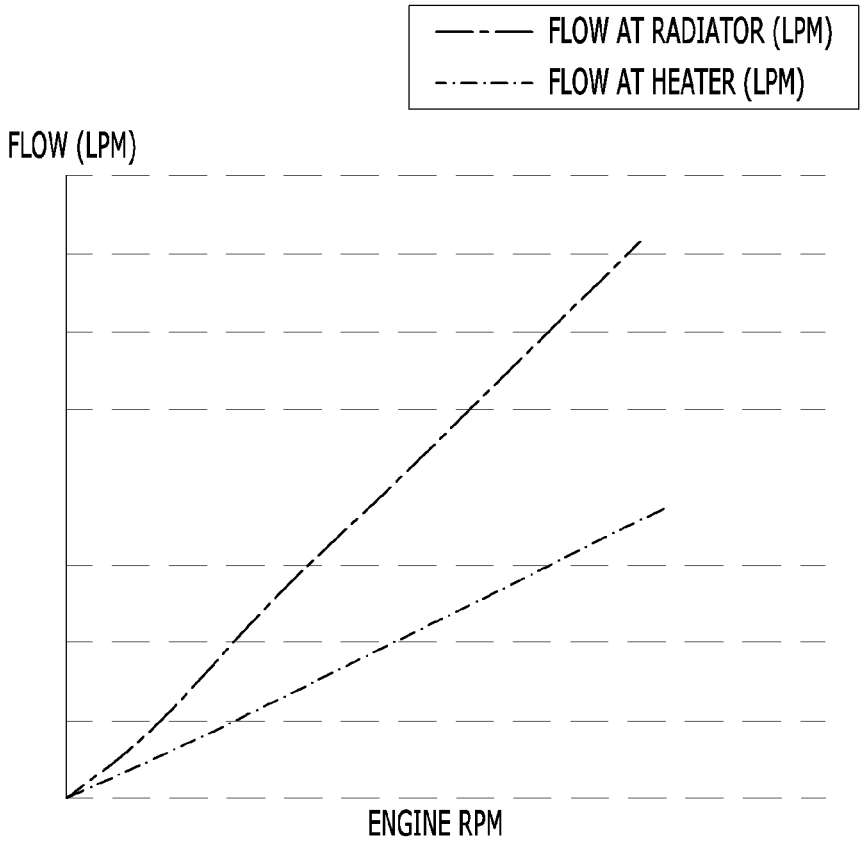
FIG. 13 is a graph showing a flow of coolant depending on the engine RPM in the engine cooling system according to one form of the present disclosure.

FIG. 13 is a graph showing a flow of coolant depending on the engine rpm in the engine cooling system according to one form of the present disclosure.

Referring to FIG. 13, the horizontal axis represents the RPM of the engine 100 and the vertical axis represents the flow of the coolant. A lower line represents the flow of coolant passing through a heater and an upper line represents the amount of coolant passing through the radiator 110.

As illustrated in FIG. 13, it can be seen that the flow of the coolant increases in proportion to the RPM of the engine 100 and when the RPM of the engine 100 is sensed, the control unit 140 may inversely calculate the flow of coolant passing through a set low point.

Figure 14:
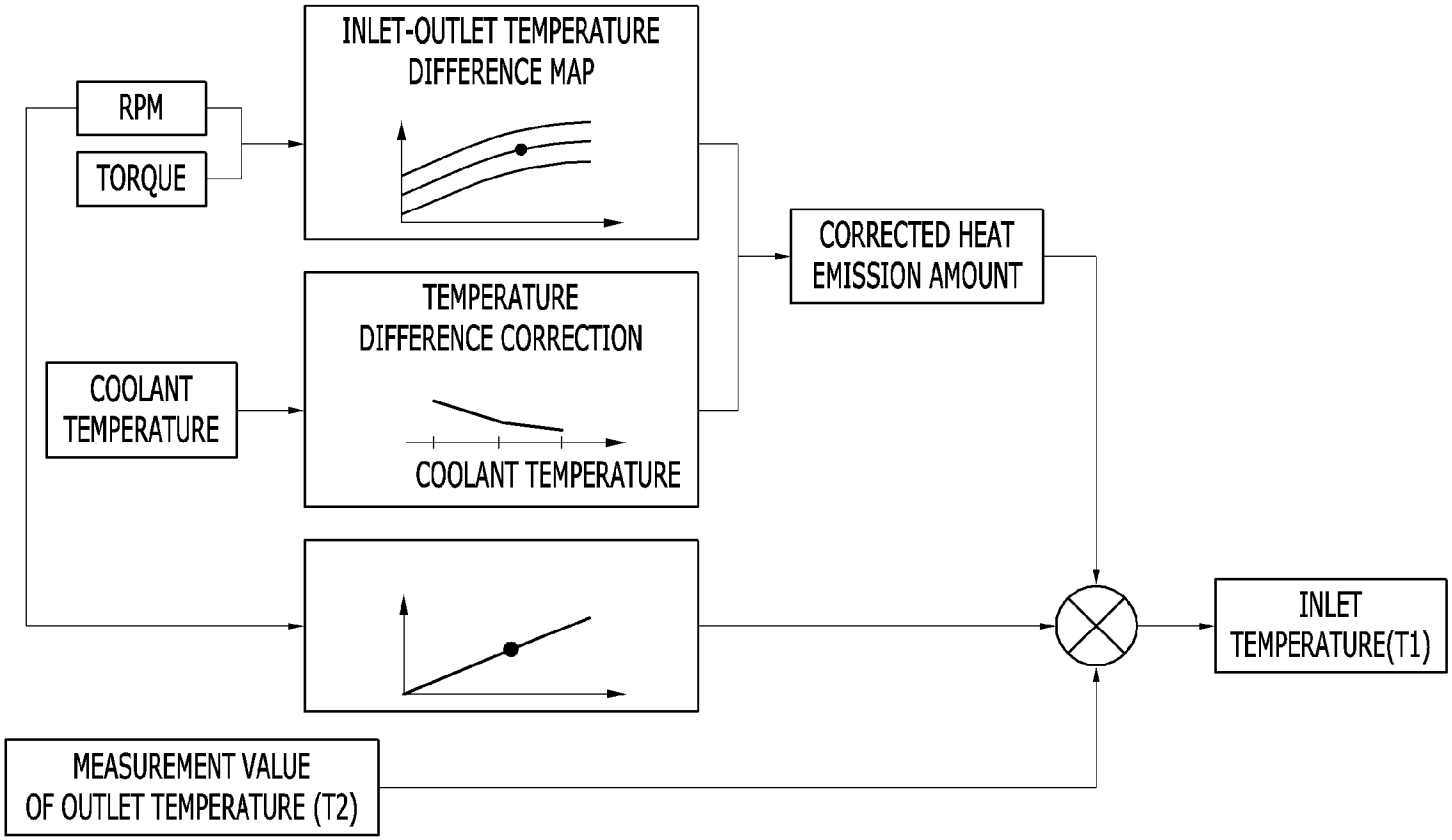
FIG. 14 is a graph showing a method for calculating a coolant temperature at a coolant inlet side of the engine depending on a driving condition in the engine cooling system according to one form of the present disclosure.

FIG. 14 is a graph showing a method for calculating a coolant temperature at a coolant inlet side of the engine depending on a driving condition in the engine cooling system according to one form of the present disclosure.

Referring to FIG. 14, the heat transfer amount of the engine 100 is selected by using the RPM and the torque of the engine 100, the heat transfer amount is corrected according to the coolant temperature (for example, T2), and the corrected engine heat transfer amount is corrected.

Moreover, the flow of the coolant passing through the engine 100 is selected according to the PRM of the engine 100 and T1 is calculated according to the outlet temperature T2.

In one form of the present disclosure, the opening rate of the valve 200 is calculated by using the calculated first coolant temperature T1, and the second coolant temperature T2 and the third coolant temperature T3 sensed by the second coolant temperature sensor 115 and the third coolant temperature sensor 120, respectively, and as a result, the opening rate of the valve 200 is adjusted.

While this disclosure has been described in connection with what is presently considered to be practical forms, it is to be understood that the disclosure is not limited to the disclosed forms. On the contrary, it is intended to cover various modifications and equivalent arrangements included within the spirit and scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An engine cooling system having a plurality of coolant temperature sensors, the plurality of coolant temperature sensors including a first coolant temperature sensor to sense a second coolant temperature corresponding to a coolant outlet side of an engine, and a second coolant temperature sensor to sense a third coolant temperature corresponding to a coolant outlet side of a radiator, the engine cooling system comprising:

a coolant control valve unit disposed in the engine cooling system to control a flow of coolant passed through the radiator and a flow of coolant discharged from the engine by an opening rate of the coolant control valve unit; and a control unit programmed to control the coolant control valve unit according to an operation condition of the engine and each of the sensed second coolant temperature and the sensed third coolant temperature, wherein the control unit calculates:

a first coolant temperature corresponding to a coolant inlet side of the engine, the calculated first coolant temperature being based on a heat transfer amount of the engine, the flow of coolant discharged from the engine, and each of the sensed second coolant temperature and the sensed third coolant temperature, and a valve opening rate of the coolant control valve unit, the calculated valve opening rate being based on each of the calculated first coolant temperature, the sensed second coolant temperature, and the sensed third coolant temperature; and wherein the control unit executes a feed-forward control of the coolant control valve unit in order to reach the calculated valve opening rate.

2. The engine cooling system of claim 1, wherein:

the first coolant temperature sensor is disposed at the coolant outlet side of the engine, the coolant control valve unit is disposed downstream of the first coolant temperature sensor, and the radiator is disposed in a branch coolant line that diverges from a main coolant line at a location downstream of the first coolant temperature sensor, and the flow of coolant discharged from the engine and the flow of coolant passed through the radiator are joined in the coolant control valve unit, and thereafter, circulated toward the coolant inlet side of the engine.

3. The engine cooling system of claim 1, wherein:

the control unit is programmed to determine the calculated first coolant temperature using a predetermined map data corresponding to at least one of the sensed second and third coolant temperatures, engine revolutions per minute (RPM), and an output torque of the engine.

4. The engine cooling system of claim 3, wherein:

the valve opening rate of the coolant control valve unit is calculated using an equation where $$\text{valve opening rate } (a)=(B0*(T2-T1))/(A1*(T1-T3)\cdot(B1-B0)*(T2-T1)),$$

where,

B0 represents an engine coolant flow rate when there is no flow of coolant being passed through the coolant control valve unit from the radiator, T2 represents the sensed second coolant temperature, T1 represents the calculated first coolant temperature, A1 represents a radiator coolant flow rate when there is a maximum flow of coolant being passed through the coolant control valve unit from the radiator, T3 represents the sensed third coolant temperature, and B1 represents the engine coolant flow rate when there is a maximum flow of coolant being passed through the coolant control valve unit from the radiator.

5. The engine cooling system of claim 1, wherein:

the control unit is programmed to determine the heat transfer amount of the engine and the flow of coolant discharged from the engine using at least one of the sensed second and third coolant temperatures, engine revolutions per minute (RPM), and an output torque of the engine.

6. The engine cooling system of claim 5, wherein:

the control unit calculates the first coolant temperature using an equation where $$Q=M*Cp*(T2-T1),$$

where,

Q represents the heat transfer amount of the engine,

M represents an engine coolant flow rate,

Cp represents a coolant specific heat,

T2 represents the sensed second coolant temperature, and

T1 represents the calculated first coolant temperature.

7. The engine cooling system of claim 1, wherein:

the feed-forward control of the coolant control valve unit is achieved through at least one of Proportional-Integral (PI) control, Proportional-Integral-Derivative (PID) control, and predetermined map data according to the operation condition of the engine.

* * * * *